US009640872B2

(12) United States Patent
Atsumi et al.

(10) Patent No.: US 9,640,872 B2
(45) Date of Patent: May 2, 2017

(54) RADAR ANTENNA AND RADAR ANTENNA MANUFACTURING METHOD

(71) Applicant: Furuno Electric Co., Ltd., Nishinomiya (JP)

(72) Inventors: Koji Atsumi, Nishinomiya (JP); Makoto Oda, Nishinomiya (JP)

(73) Assignee: Furuno Electric Co., Ltd., Nishinomiya (JP)

( * ) Notice: Subject to any disclaimer, the term of this patent is extended or adjusted under 35 U.S.C. 154(b) by 256 days.

(21) Appl. No.: 14/088,316

(22) Filed: Nov. 22, 2013

(65) Prior Publication Data

US 2014/0145908 A1 May 29, 2014

(30) Foreign Application Priority Data

Nov. 27, 2012 (JP) ..... 2012-258700

(51) Int. Cl.
*H01Q 1/12* (2006.01)
*H01Q 13/28* (2006.01)
*H01Q 3/04* (2006.01)

(52) U.S. Cl.
CPC ..... *H01Q 13/28* (2013.01); *H01Q 1/1207* (2013.01); *H01Q 3/04* (2013.01); *Y10T 29/49016* (2015.01)

(58) Field of Classification Search
CPC ..... H01Q 1/1207; H01Q 1/12
USPC ..... 343/878
See application file for complete search history.

(56) References Cited

U.S. PATENT DOCUMENTS 3,412,404 A * 11/1968 Bergling ..... H01Q 1/084 343/714
4,903,442 A * 2/1990 Trommen ..... B64F 1/20 174/45 R
2009/0315801 A1* 12/2009 Welsh ..... H01Q 3/08 343/841

FOREIGN PATENT DOCUMENTS

| | | | |
|---|---|---|---|
| EP | 1511118 | A1 | 3/2005 |
| GB | 2158650 | A | 11/1985 |
| GB | 2461161 | A | 12/2009 |
| JP | S60216605 | A | 10/1995 |

OTHER PUBLICATIONS

"Consilium Selux ST Radar Line," Consilium AB, Accessed Nov. 14, 2013, 11 pages.

* cited by examiner

*Primary Examiner* — Graham Smith
(74) *Attorney, Agent, or Firm* — Alleman Hall McCoy Russell & Tuttle LLP

(57) ABSTRACT

A radar antenna is provided. The radar antenna includes an antenna unit provided with dielectric bodies in a front part thereof in a radio wave radiating direction, a housing unit for supplying a radio wave to the antenna unit, and an antenna supporting unit made of FRP attached between the antenna unit and the housing unit to separate the antenna unit from the housing unit.

11 Claims, 4 Drawing Sheets

RADAR ANTENNA AND RADAR ANTENNA MANUFACTURING METHOD

CROSS-REFERENCE TO RELATED APPLICATION(S)

This application claims priority under 35 U.S.C. §119 to Japanese Patent Application No. 2012-258700, which was filed on Nov. 27, 2012, the entire disclosure of which is hereby incorporated by reference.

TECHNICAL FIELD

The present invention relates to a radar antenna including an antenna unit having dielectric bodies.

BACKGROUND OF THE INVENTION

Conventionally, radar antennas each including an antenna unit and a housing unit has been known. The antenna unit radiates outside radio waves. The housing unit is built therein with a motor for rotating the antenna unit, a coaxial cable for supplying radio waves to the antenna unit, etc.

Moreover, various kinds of antenna units have conventionally been known, such as, an antenna unit having a shape in which the cross-section of an opening part thereof gradually spreads toward outside (horn shape, trumpet shape). In supporting the horn-shaped antenna unit, it has been known that even if a metal is disposed right beneath or behind the horn part, it does not give any influence on a beam formation. Therefore, conventionally, in order to stably support the horn-shaped antenna unit, the antenna unit is generally substantially directly attached to the housing unit (with an attaching plate interposing therebetween).

Moreover, JP1991-042723A discloses an antenna unit having dielectric bodies. The antenna unit includes a dielectric body waveguide mechanism comprised of two dielectric body flat plates opposing to each other.

However, with the antenna unit having the dielectric bodies as disclosed in JP1991-042723A, when a metal is disposed near the antenna unit, a beam cannot be formed appropriately. Therefore, the antenna unit having the dielectric bodies is preferred not to be disposed near the housing body, different from the conventional horn-shaped antenna unit.

In this regard, JP1991-042723A only discloses the configuration having the shape of the antenna unit with the dielectric bodies, and the details in supporting the antenna unit are not disclosed. For this reason, an appropriate configuration for supporting an antenna unit having dielectric bodies has been desired.

Note that, in JP1991-042723A, the dielectric body flat plates are disclosed to be made of FRP. Here, only the configuration of using FRP to the dielectric body waveguide mechanism of the antenna unit is disclosed and the use of FRP to other members is not disclosed.

SUMMARY OF THE INVENTION

The present invention is made in view of the above situations, and mainly aims to provide a radar antenna including an antenna unit having dielectric bodies and for supporting the antenna unit such that a beam formation is not negatively influenced.

One aspect of the present invention provides a radar antenna. The radar antenna includes an antenna unit, a housing unit, and an antenna supporting unit. The antenna unit is provided with dielectric bodies in a front part thereof in a radio wave radiating direction. The housing unit supplies a radio wave to the antenna unit. The antenna supporting unit is attached between the antenna unit and the housing unit to separate the antenna unit from the housing unit.

Thus, since the antenna unit can be separated from the housing unit, a beam can be formed appropriately.

The antenna supporting unit may include a pedestal attached to the housing unit, an attaching base attached to the antenna unit, and a plurality of supporting bars connecting the pedestal with the attaching base.

Thus, the antenna unit can be separated from the housing unit with the simple configuration. Although influence of wind is easily received due to the separation of the antenna unit from the housing unit, wind can pass through between the plurality of supporting bars with the configuration described above. Therefore, the radar antenna can be supported stably.

The antenna supporting unit may be made of FRP. Thus, by building the antenna supporting unit with FRP, which has excellent an electrical properties, the influence on the beam formation can be reduced more. Further, by using FRP, an antenna supporting unit having a light weight, thermal resistance, and corrosion resistance can be realized.

The antenna supporting unit may be built by connecting members made of FRP with each other in an overlapped manner.

Thus, the strength of the antenna supporting unit can be improved compared to the configuration of creating the components individually and fixing therebetween with fastening tools (e.g., screws).

At least a part of one of the supporting bars, at least a part of another one of the supporting bars adjacent thereto, and a part of the pedestal between the two supporting bars may be formed by a single FRP sheet.

Thus, the parts where a stress easily concentrates can be built integrally instead of separately. Therefore, the strength of the antenna supporting unit can be improved.

At least a part of an outermost supporting bar and an end part of the pedestal may be formed by a single FRP sheet.

Thus, the parts where a stress easily concentrates can be built integrally instead of separately. Therefore, the strength of the antenna supporting unit can be improved.

The plurality of supporting bars may include two supporting bars. A gap between the supporting bars on the pedestal side may be less than that on the attaching base side.

Thus, the antenna unit can be supported stably even if the number of supporting bars is two.

The contour of the supporting bar may be a solid cylindrical shape.

Thus, the radar antenna can pass wind rearward. Therefore, the antenna unit can be supported more stably.

The antenna supporting unit may incline toward a rear part of the antenna unit in the radio wave radiating direction.

Generally, when the antenna supporting unit supports the antenna unit having the dielectric bodies, it supports the rear part of the antenna unit in the radio wave radiating direction so as to suppress the influence of the radio wave characteristic. Therefore, by inclining the antenna supporting unit as described above, the center of gravity of the antenna unit can be drawn close to the axis of rotation of the antenna unit. Thus, the antenna unit can be supported stably.

At least one of the supporting bars may incline in a longitudinal direction of the antenna unit.

Thus, the antenna unit can be supported more stably compared to the configuration of supporting the center part of the antenna unit.

The supporting bars may be hollow therein.

Thus, when using FRP, since the hollow member is more convenient to form compared to the solid member, the manufacturing cost of the antenna supporting units can be reduced. Moreover, the antenna supporting unit can be reduced in weight.

Another aspect of the present invention provides a method of manufacturing radar antennas. The method includes connecting components formed by FRP with each other in an overlapped manner, and building an antenna supporting unit for separating an antenna unit from a housing unit. The method also includes attaching the antenna supporting unit to the housing unit for supplying a radio wave to be radiated from the antenna unit. The method also includes attaching the antenna unit to the antenna supporting unit, the antenna unit being provided with dielectric bodies in a front part thereof in a radio wave radiating direction.

Thus, the antenna unit can be separated from the housing unit. Therefore, radar antennas that can appropriately form beams can be manufactured.

BRIEF DESCRIPTION OF THE DRAWINGS

The present disclosure is illustrated by way of example and not by way of limitation in the figures of the accompanying drawings, in which the like reference numerals indicate like elements and in which.

DETAILED DESCRIPTION

Figure 1:
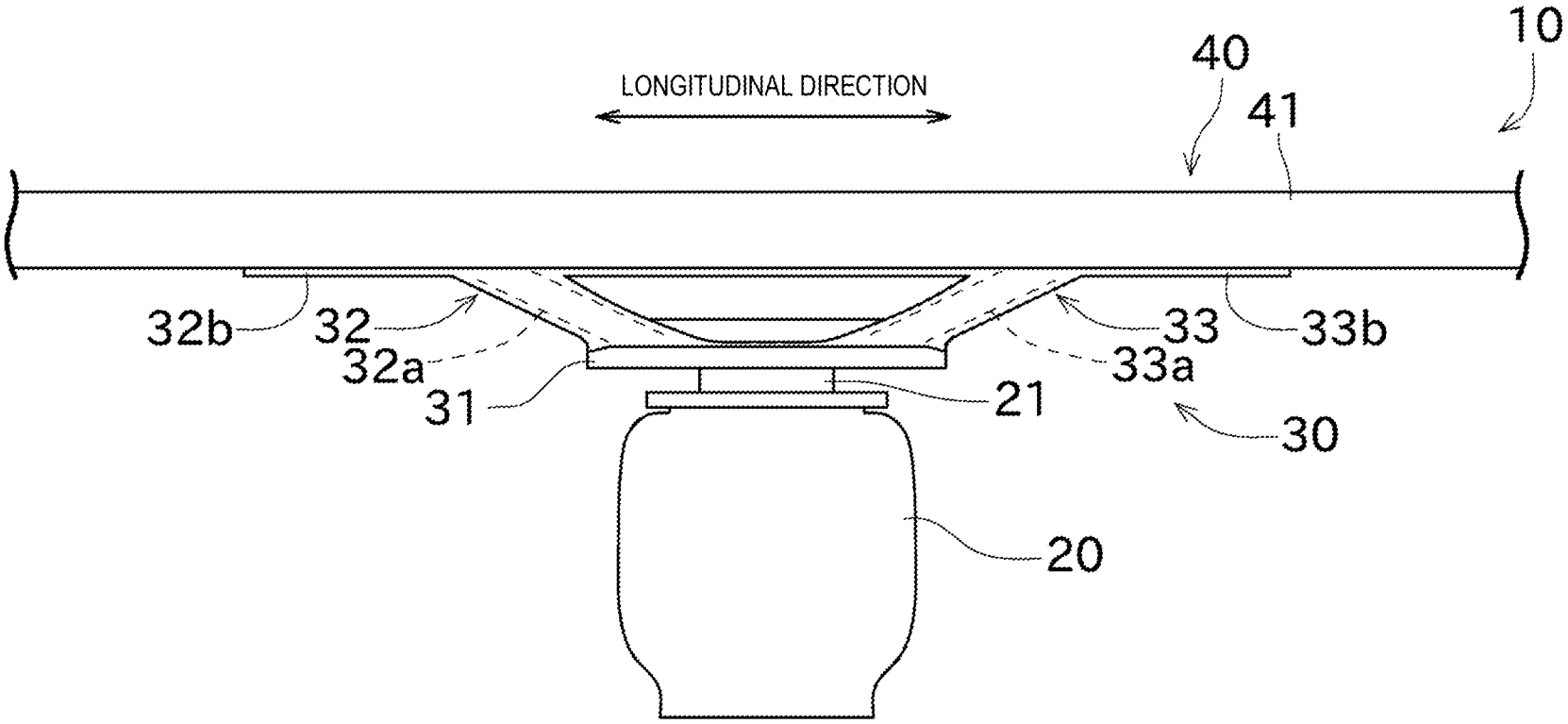
FIG. 1 is a schematic front view of a radar antenna according to one embodiment of the present invention.
Figure 2:
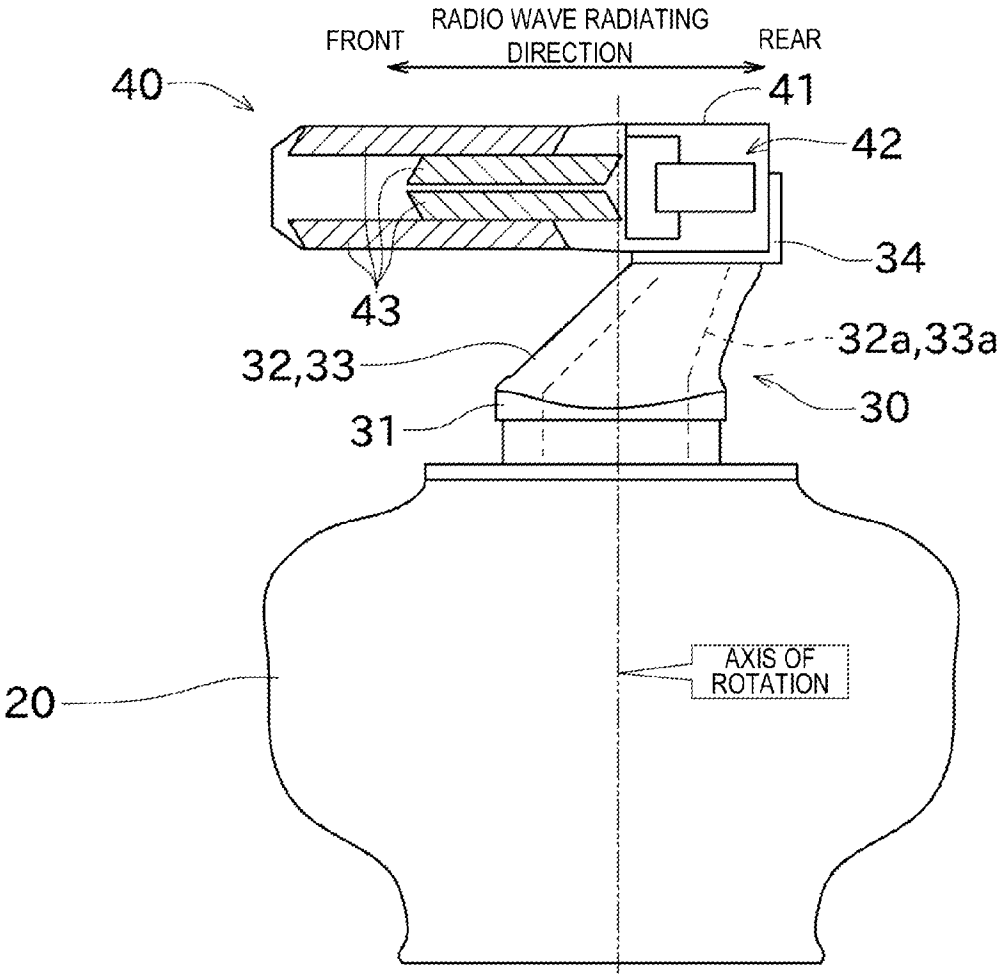
FIG. 2 is a schematic side view of the radar antenna.

Next, one embodiment of the present invention is described with reference to the accompanying drawings. FIG. 1 is a schematic front view of a radar antenna according to this embodiment of the present invention. FIG. 2 is a schematic side view of the radar antenna.

A radar antenna 10 radiates pulse-shaped radio waves and receives reflection waves of the radiated radio waves. The radar antenna 10 repeats transception of the radio waves while rotating in the horizontal plane. Each reflection wave received by the radar antenna 10 is analyzed by a transceiver, an indicator and the like (not illustrated). Thus, a position, a speed and the like of a target object existing around the radar antenna 10 can be obtained.

As illustrated in FIGS. 1 and 2, the radar antenna 10 includes a housing unit 20, an antenna supporting unit 30, and an antenna unit 40 having dielectric bodies.

The housing unit 20 is a box-like member accommodating various components. The housing unit 20 includes a motor for driving a rotational shaft 21 for rotating the antenna unit 40, and a circuit and a magnetron for generating the radio wave to be radiated from the antenna unit 40. Moreover, the housing unit 20 is connected with the antenna unit 40 via a coaxial cable (or a waveguide, etc.), and the antenna unit 40 can radiate outside the radio wave supplied from the housing unit 20.

As described above, the antenna unit 40 having the dielectric bodies cannot appropriately form a beam if a metal exists on a front side or obliquely front side thereof in a radio wave radiating direction. In this embodiment, considering this point, the antenna supporting unit 30 made of FRP (Fiber Reinforced Plastic) is provided. In this embodiment, a forward direction of the radio wave radiating direction corresponds to a forward direction of the antenna unit 40, and a backward direction of the radio wave radiating direction corresponds to a rearward direction of the antenna unit 40.

The antenna supporting unit 30 separates the antenna unit 40 from the housing unit 20. Thus, the influence that the housing unit 20 gives the beam formation can be reduced. Note that, the separating distance is preferred to correspond to one wavelength or more of the radio wave to be radiated (about 10 cm when the transmission frequency is 3 GHz). Moreover, since FPR has a characteristic that it does not easily influence radio waves, the beam formation is rarely influenced. Note that, among various kinds of FRP, GFRP (Glass Fiber Reinforced Plastic) is preferred to be the material of the antenna supporting unit 30 considering the influence on radio waves.

Moreover, FRP (GFRP) excels in its light weight, thermal resistance, and corrosion resistance, as well as having a small influence on radio waves. Especially, since this embodiment is applied to a ship radar apparatus, FRP is suitable considering the possibility of receiving strong wind and seawater.

Figure 3:
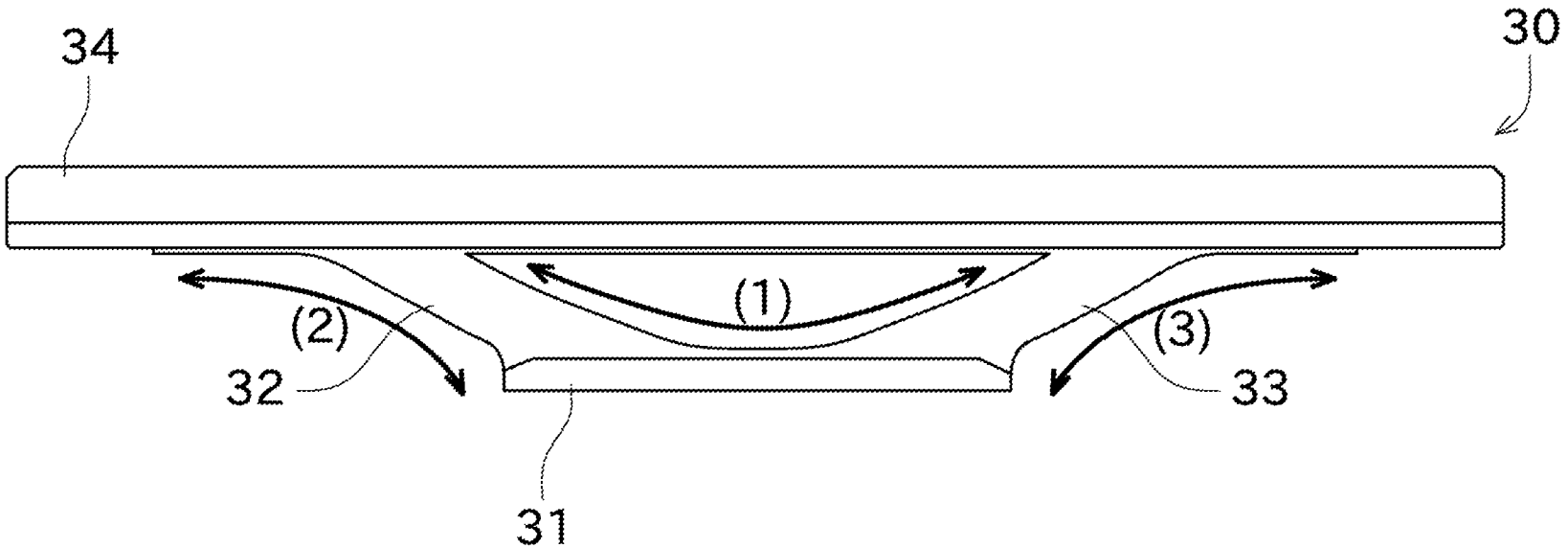
FIG. 3 is a front view of an antenna supporting part.
Figure 4:
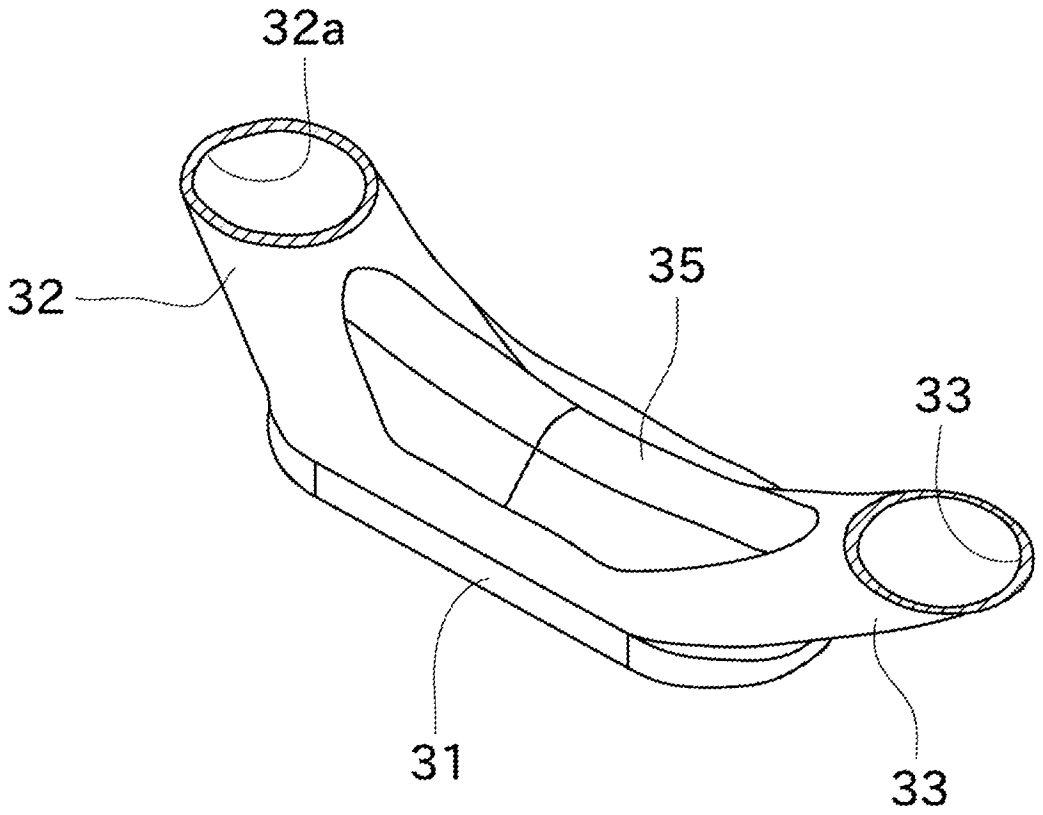
FIG. 4 is a cross-sectional perspective view of the antenna supporting part.

Hereinafter, a specific configuration of the antenna supporting unit 30 is described. As illustrated in FIGS. 1 and 3, the antenna supporting unit 30 includes a pedestal 31, supporting bars 32 and 33, an attaching base 34, and a cover 35. Moreover, the supporting bar 32 is formed with a hollow section 32*a* and a fixed portion 32*b*, and the supporting bar 33 is formed with a hollow section 33*a* and a fixed portion 33*b*.

The pedestal 31 is a plate-like member attached to the housing unit 20. The pedestal 31 is connected with the two supporting bars 32 and 33.

The supporting bars 32 and 33 are cylindrical members (members with cylindrical contours) and are formed to connect the pedestal 31 with the attaching base 34. Moreover, the supporting bars 32 and 33 are arranged such that a gap between the supporting bars 32 and 33 is wider on the attaching base 34 side (antenna unit 40 side) than the pedestal 31 side (arranged in a substantially V-shape). In other words, the supporting bars 32 and 33 incline toward different end parts of the attaching base 34 (antenna unit 40) from each other in a longitudinal direction of the attaching base 34 (see FIG. 1) (incline in the longitudinal direction of the antenna unit 40).

Moreover, as illustrated in FIG. 2, the supporting bars 32 and 33 extend to the attaching base 34 (antenna unit 40) while inclining toward a rear part of the antenna unit 40 (backward in the radio wave radiating direction) for the following reasons.

That is, with the antenna unit 40 having the dielectric bodies, in order to prevent the influence on the beam formation, it is not preferred to locate the antenna supporting unit 30 at a front part of the antenna unit 40 in the radio wave radiating direction. Therefore, the antenna supporting unit 30 supports the rear part of the antenna unit 40.

Therefore, if the antenna supporting unit 30 extends straight with no inclination, the center of gravity of the antenna unit 40 will be largely offset from an axis of rotation of the antenna unit 40. In this case, it becomes difficult to stably support the antenna unit 40 that is rotating.

In this regard, in this embodiment, by inclining the supporting bars 32 and 33 backward in the radio wave radiating direction, the center of gravity of the antenna unit 40 can be drawn close to the axis of rotation of the antenna unit 40. Therefore, the antenna 40 that is rotating can be stably supported.

The hollow sections 32*a* and 33*a* are hollow areas of the cylindrical supporting bars 32 and 33. A plurality of layers of FRP are required to be formed so as to thicken the respective members of the antenna supporting unit 30. Therefore, the manufacturing cost is cheaper to create a hollow member than to create a solid member.

The fixed portions 32*b* and 33*b* are plate-like portions formed at contacting positions with the attaching base 34. A through hole is formed in each of the fixed portions 32*b* and 33*b*, and by inserting a fixing tool (e.g., a bolt) into the through hole to be attached thereto, the supporting bars 32 and 33 can be fixed to the attaching base 34.

The attaching base 34 is disposed between the supporting bars 32 and 33, and the antenna unit 40. The attaching base 34 is a long-and-thin member having an L-shaped cross-section and is attached to the antenna unit 40 by contacting a lower surface (surface on the housing unit 20 side) and a rear surface (surface on the backward side in the radio wave radiating direction) of the antenna unit 40. Note that, by forming the attaching base 34 to have the L-shaped cross-section, the antenna unit 40 can surely be fixed and the strength of the attaching base 34 can be improved.

The cover 35 covers a section between the supporting bar 32 and the supporting bar 33.

The antenna unit 40 is an end-feed-type slot array antenna and can radiate the radio wave in the direction indicated by the arrow (forward arrow) in FIG. 2. As illustrated in FIG. 2, the antenna unit 40 includes an antenna case 41, a radiating part 42, and a plurality of dielectric body parts 43.

The antenna case 41 is a case for covering the respective members configuring the antenna unit 40. Note that, to facilitate the view inside the radar antenna 10, the antenna case 41 is only illustrated about its contour in FIG. 2.

The radiating part 42 radiates outside the radio wave supplied from, for example, the coaxial cable. The radiating part 42 is comprised of a radiation waveguide formed in the longitudinal direction of the antenna unit 40. The radiation waveguide is a tubular member made of metal, where slits are formed at a predetermined interval. The radiation waveguide radiates, from the slits to outside (in the radio wave radiating direction), the radio wave supplied from, for example, the coaxial cable.

The dielectric body parts 43 made of foamed dielectric bodies are disposed in the front part of the antenna unit 40 in the radio wave radiating direction. Specifically, two plates of the dielectric bodies are arranged parallel to each other via a predetermined interval therebetween, and two more plates of the dielectric bodies are disposed outward thereof, respectively. A directivity angle (a beam width in a perpendicular direction to the dielectric body parts 43) of the radio wave radiated from the radiation part 42 is controlled according to the interval of the dielectric body parts 43. Note that, the directivity angle can also be adjusted by changing a permittivity of the dielectric body parts 43, in addition to the interval of the dielectric body parts 43.

According to the configuration described above, the radar antenna 10 can radiate outside the radio wave generated by using the magnetron and the like at a predetermined directivity angle.

Next, a method of building the antenna supporting unit 30 is described with reference to FIG. 3. Note that, to facilitate the view of the drawings, the cover 35 is not illustrated in FIG. 3.

In this embodiment, the antenna supporting unit 30 made of FRP separates the antenna unit 40 from the housing unit 20 so as to form the beam appropriately. However, generally, as the antenna unit 40 is separated by the supporting bars, a stress concentrates on the end portions of the supporting bars and it is concerned that one or both of the end portions of the supporting bars may break.

In this regard, in this embodiment, the breakage is prevented by building the supporting bars 32 and 33 and the pedestal 31 in the following method. Specifically, the portions indicated by a single thick line with arrows at its both ends in FIG. 3 is formed by a single sheet of FRP.

Specifically, in this embodiment, as indicated by (1) of FIG. 3, a portion of the supporting bar 32 and a portion of the supporting bar 33 (the portions at least including the surfaces thereof on the attaching base 34 side) and a surface of the pedestal 31 (the portion at least including the surface thereof on the attaching base 34 side) are formed integrally by a single FRP sheet. Here, the manufacturing method of FRP generally includes overlapping layers from an outermost layer by using an outer mold. Therefore, the part indicated by (1) can be built only by forming FRP, using a relevant mold.

Moreover, in this embodiment, the portions indicated by (2) and (3) of FIG. 3, in other words, a portion of the supporting bar 32 (the portion at least including the surface thereof on the housing unit 20 side) and a surface of the pedestal 31 (the portion at least including a side surface thereof) are formed integrally by a single FRP sheet, and a portion of the supporting bar 33 (the portion at least including the surface thereof on the housing unit 20 side) and a surface of the pedestal 31 (the portion at least including a side surface thereof) are formed integrally by a single FRP sheet. The portions indicated by (2) and (3) of FIG. 3 only require to form FRP by using respective relevant molds, similarly to the portions indicated by (1). Note that, in view of the strength and the like of the antenna supporting unit 30, the directions indicated by the arrows in FIG. 3 are preferred to be matched with the direction of glass fiber.

Next, an operator assembles the three members built as described above and then forms FRP again at connecting positions. Thus, the antenna supporting unit 30 can be built in which the portions where the stress concentrates are integrally built. By building the antenna supporting unit 30 integrally as above, the breakage at the connecting positions of the supporting bars 32 and 33 and the pedestal 31 can be prevented.

As described above, the radar antenna 10 of this embodiment includes the antenna unit 40, the housing unit 20, and the antenna unit 30. The antenna unit 40 is provided with the dielectric body parts 43 in the front part thereof in the radio wave radiating direction. The housing unit 20 supplies the radio wave to the antenna unit 40. The antenna supporting unit 30 is the member made of FRP that is attached between the antenna unit 40 and the housing unit 20 to separate the antenna unit 40 from the housing unit 20.

Thus, since the antenna unit 40 can be separated from the housing unit 20, the beam can be formed appropriately. Moreover, by building the antenna supporting unit 30 with FRP excelling in an electrical property, the influence on the beam formation can be reduced more. Further, by using FRP, the antenna supporting unit 30 having a light weight, thermal resistance, and corrosion resistance can be realized.

Although the preferred embodiment of the present invention is described above, the above configuration may be modified as follows.

The number of the supporting bars 32 and 33 is not limited to two, but may be one, three or more. Moreover, the antenna supporting unit 30 may be adjusted in its height by using a different member (e.g., box-shaped member) instead of the supporting bars.

The installing angles of the supporting bars 32 and 33 are arbitrary and do not need to incline backward in the radio wave radiating direction while inclining in the longitudinal direction. Moreover, the shapes of the supporting bars 32 and 33 are not limited to the cylindrical-shapes, but may be solid cylindrical shapes, cross-sectionally rectangular-shapes, etc.

The portions formed by a single sheet FRP are arbitrary and may suitably be changed according the configuration, the shape and the like of the antenna supporting unit 30.

The present invention is not limited to the radar antenna for ships but may also be applied to radar antennas provided to other movable bodies (navigation bodies, such as automobiles, airplanes, etc.). Moreover, the present invention may also be applied to radar antennas of radar apparatuses which perform observations at fixed positions.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A radar antenna, comprising:

an antenna unit provided with dielectric bodies in a front part thereof in a radio wave radiating direction;

a housing unit for supplying a radio wave to the antenna unit and configured to rotate the antenna unit with a rotational shaft, a rotational axis of the rotational shaft perpendicular to a longitudinal direction of the antenna unit; and an antenna supporting unit attached between the antenna unit and the housing unit to separate the antenna unit from the housing unit, the antenna supporting unit including:

a pedestal attached to the housing unit;

an attaching base attached to the antenna unit; and a plurality of supporting bars with a gap therebetween, the plurality of supporting bars connecting the pedestal with the attaching base;

wherein the antenna supporting unit is built by connecting members made of FRP with each other in an overlapped manner; and wherein at least a part of one of the supporting bars, at least a part of another one of the supporting bars adjacent thereto, and a part of the pedestal between the two supporting bars are formed by a single FRP sheet.

2. A radar antenna, comprising:

an antenna unit provided with dielectric bodies in a front part thereof in a radio wave radiating direction;

a housing unit for supplying a radio wave to the antenna unit and configured to rotate the antenna unit with a rotational shaft, a rotational axis of the rotational shaft perpendicular to a longitudinal direction of the antenna unit; and an antenna supporting unit attached between the antenna unit and the housing unit to separate the antenna unit from the housing unit, the antenna supporting unit including:

a pedestal attached to the housing unit;

an attaching base attached to the antenna unit; and a plurality of supporting bars with a gap therebetween, the plurality of supporting bars connecting the pedestal with the attaching base;

wherein the antenna supporting unit is built by connecting members made of FRP with each other in an overlapped manner; and wherein at least a part of an outermost supporting bar and an end part of the pedestal are formed by a single FRP sheet.

3. The radar antenna of claim 1, wherein the plurality of supporting bars include two supporting bars, and wherein the gap between the supporting bars on a pedestal side is less than that on an attaching base side.

4. The radar antenna of claim 1, wherein a contour of each supporting bar is a solid cylindrical shape.

5. The radar antenna of claim 1, wherein at least one of the supporting bars inclines in the longitudinal direction of the antenna unit.

6. The radar antenna of claim 1, wherein the supporting bars are hollow therein.

7. The radar antenna of claim 1, wherein the antenna supporting unit inclines toward a rear part of the antenna unit in the radio wave radiating direction.

8. The radar antenna of claim 2, wherein the plurality of supporting bars include two supporting bars, and wherein the gap between the supporting bars on a pedestal side is less than that on an attaching base side.

9. The radar antenna of claim 2, wherein a contour of each supporting bar is a solid cylindrical shape.

10. The radar antenna of claim 2, wherein at least one of the supporting bars inclines in the longitudinal direction of the antenna unit.

11. The radar antenna of claim 2, wherein the supporting bars are hollow therein.

* * * * *